US005209076A

United States Patent [19]

Kauffman et al.

[11] Patent Number: 5,209,076

[45] Date of Patent: May 11, 1993

[54] CONTROL SYSTEM FOR PREVENTING COMPRESSOR DAMAGE IN A REFRIGERATION SYSTEM

[75] Inventors: Gary O. Kauffman, Olathe, Kans.; Michael L. Hobbs, Kansas City, Mo.

[73] Assignee: Izon, Inc., Lenexa, Kans.

[21] Appl. No.: 894,440

[22] Filed: Jun. 5, 1992

[51] Int. Cl.[5] ..... F25B 41/00

[52] U.S. Cl. ..... 62/126; 62/127; 62/209; 62/228.3

[58] Field of Search ..... 62/228.1, 228.3, 126, 62/127, 129, 158, 227, 83, 208, 209

[56] References Cited

U.S. PATENT DOCUMENTS

| | | | |
|---|---|---|---|
| 2,120,764 | 6/1938 | Newton | 62/3 |
| 2,448,403 | 8/1948 | Turner | 62/226 X |
| 2,451,072 | 10/1948 | Cooper | 62/227 X |
| 2,461,342 | 2/1949 | Obreiter, Jr. | 62/115 |
| 2,534,455 | 12/1950 | Koontz | 62/4 |
| 2,871,673 | 2/1959 | Richards et al. | 62/174 |
| 3,132,490 | 5/1964 | Schmidt | 62/81 |
| 3,180,567 | 4/1965 | Quiggle et al. | 230/206 |
| 3,290,576 | 12/1966 | Jensen et al. | 318/471 |
| 3,312,081 | 4/1967 | Berger et al. | 62/158 |
| 3,411,313 | 11/1968 | Brown et al. | 62/192 |
| 3,412,574 | 11/1968 | Reiter | 62/471 |
| 3,577,743 | 5/1971 | Long | 62/212 |
| 3,766,747 | 10/1973 | Parker | 62/226 |
| 3,866,427 | 2/1975 | Rothmayer et al. | 62/7 |
| 3,913,347 | 10/1975 | Stevens | 62/83 |
| 4,038,061 | 7/1977 | Anderson et al. | 62/126 |
| 4,136,822 | 1/1979 | Felter | 236/49 |
| 4,545,212 | 10/1985 | Noda | 62/129 |
| 4,563,878 | 1/1986 | Baglione | 62/158 X |
| 4,677,830 | 7/1987 | Sumikawa et al. | 62/126 |
| 4,718,250 | 1/1988 | Warren | 62/278 |
| 4,788,826 | 12/1988 | Higdon | 62/126 |

*Primary Examiner*—Harry B. Tanner

*Attorney, Agent, or Firm*—Kokjer, Kircher, Bowman & Johnson

[57] ABSTRACT

A microprocessor based device which monitors the operation of a compressor in a refrigeration system and automatically shuts the compressor down if a monitored condition is abnormal. Sensors in the refrigeration system sense conditions such as refrigerant pressure and temperature, superheat, oil pressure and motor current draw. If a sensed condition is outside of a safety range and remains there for a time out period, an alarm condition is indicated and the device generates a alarm signal and shuts down the compressor. A detachable display module includes a keypad for carrying out field programming and a LCD screen for displaying the refrigerant conditions and programming prompts and commands. A rest button permits resetting twice before a service call is required.

1 Claim, 4 Drawing Sheets

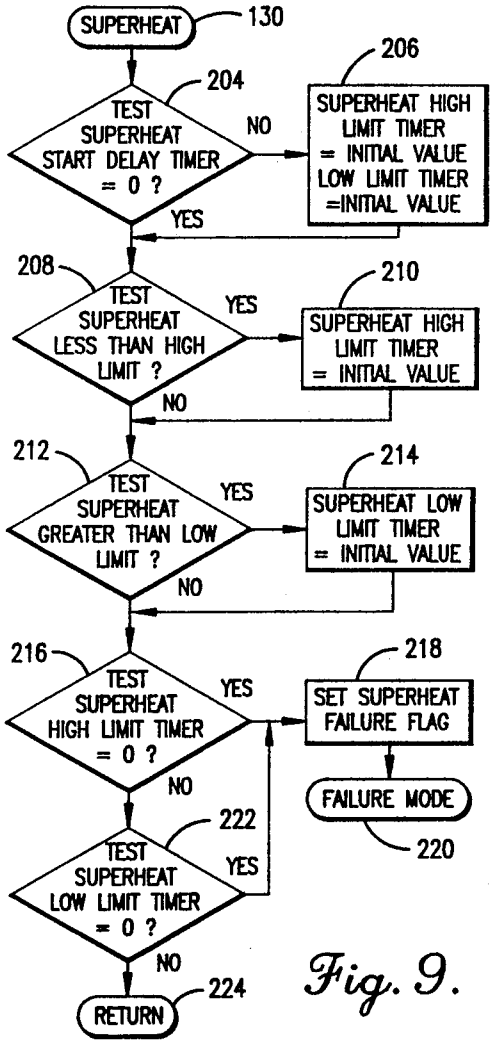
Fig. 9.
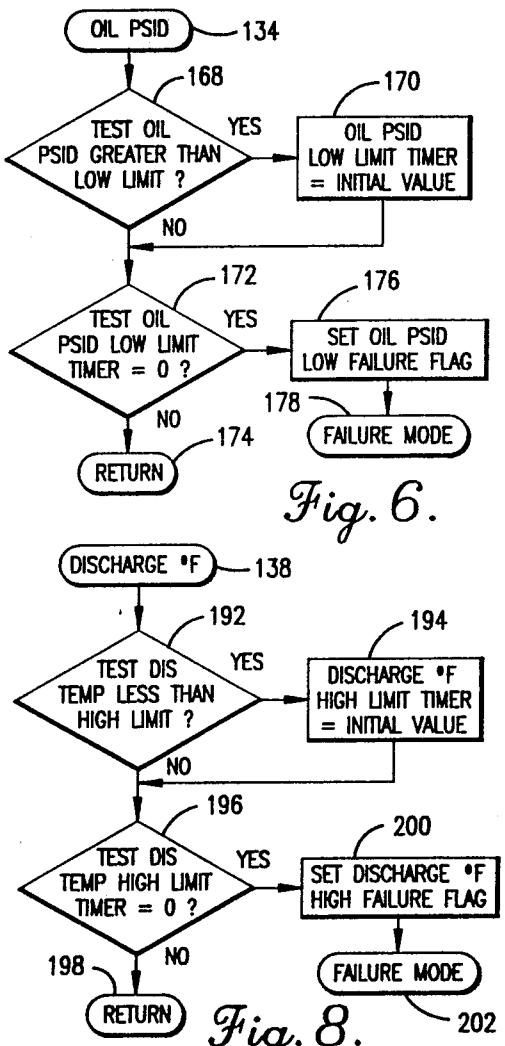
Fig. 6.
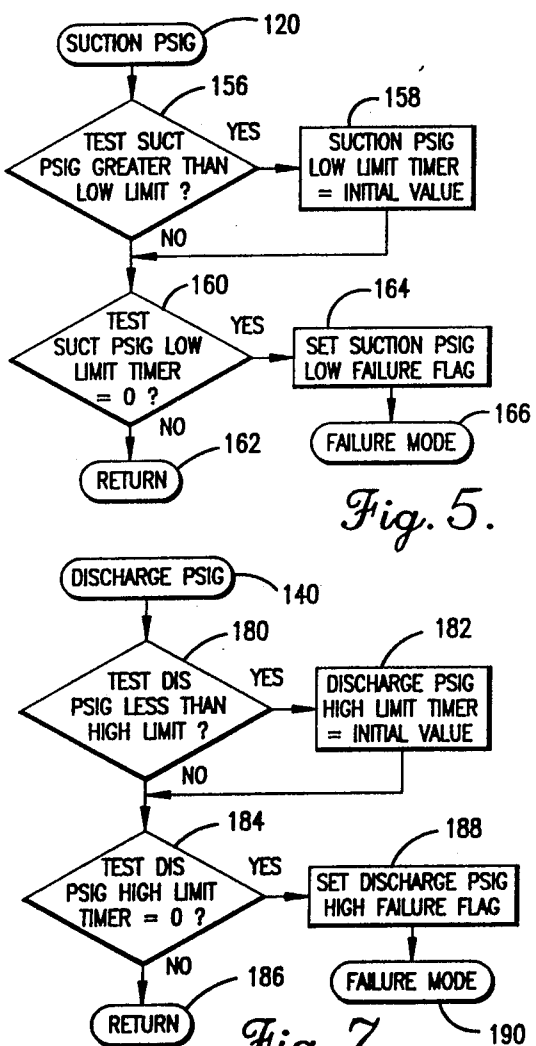
Fig. 8.
Fig. 5.
Fig. 7.

CONTROL SYSTEM FOR PREVENTING COMPRESSOR DAMAGE IN A REFRIGERATION SYSTEM

FIELD OF THE INVENTION

This invention relates generally to cooling systems and more particularly to a method and apparatus for preventing compressor damage due to the presence of refrigerant in a liquid or partially liquid state at the intake of the compressor.

BACKGROUND OF THE INVENTION

In the operation of refrigeration and air conditioning systems, a cooling effect is provided by the change of state of the refrigerant from a liquid state to a gaseous state in the evaporator. The gaseous refrigerant is compressed by a compressor and is condensed to a liquid state in a condenser before passing through an expansion valve and being delivered to the evaporator again.

The compressor is typically an expensive piece of equipment, especially in the case of a large compressor such as one used in air conditioning systems for large commercial, industrial or office buildings. One of the principal causes of compressor damage is a condition known as "floodback" or "washout" caused by the presence of undue amounts of liquid refrigerant at the compressor intake. The liquid refrigerant cannot be compressed, and its presence in the compressor causes liquid slugging and damage to various components, including valves and pistons. The liquid refrigerant also dilutes the lubricating oil in the compressor and washes lubricant away from the bearings, cylinder walls and other surfaces that are subjected to high frictional forces. Dilution of the oil and the increase in friction shortens the life of the compressor. Compressor break down has serious consequences in that it requires costly repair or replacement of the compressor, causes inconvenience and discomfort due to lack of cooling while the compressor is out of service, and can destroy expensive material in cases where cooling is needed for a critical industrial or medical process.

The presence of unduly wet refrigerant at the compressor intake is caused by a lack of superheat on the suction side of the compressor. Conversely, if the superheat is excessive, the cooling effect of the refrigerant on the compressor is reduced. This can result in overheating of the compressor motor and/or the valves and high friction areas of the compressor. If the suction pressure is unduly low, the refrigerant gas is not present in the system in sufficient amounts to adequately cool the compressor. Adverse consequences such as overheating of the motor or other parts of the compressor can result from this condition.

SUMMARY OF THE INVENTION

The present invention has, as its principal goal, the prevention of compressor damage due to inadequate superheat at the compressor intake. Another object of the invention is to monitor a wide variety of operating characteristics of a refrigeration compressor and to automatically shut off the compressor in the event of operation under conditions that can damage it.

In accordance with the invention, a microprocessor based monitoring device makes use of sensors which detect various conditions at selected locations in a refrigeration system. Pressure and temperature sensors on the suction side of the compressor provide information that allows the superheat to be computed. High and low safety limits for the superheat of the particular refrigerant can be entered. If the actual superheat falls outside of the programmed safety range, the compressor is automatically shut off and alarm signals are generated to indicate the presence of problem conditions.

Additional sensors monitor conditions such as the compressor discharge pressure and temperature, motor current draw and oil pressure. Again, safety limits are entered and the device automatically shuts down the compressor and provides an alarm signal if the system is operating outside of a safe operating range with respect to any of the conditions that are being monitored. In order to prevent aberrational or transient conditions from shutting down the compressor, each parameter that is being monitored is given a time out period during which an abnormal condition must continue before shut down occurs.

It is an important feature of the invention that the device can be reset twice after the compressor has been shut down. As a result, reset is possible following "brownouts" or other external problems that are not indicative of a problem in the refrigeration system. However, if the device is reset twice and another automatic shut down takes place, it is evident that there is a problem that can cause compressor damage or other adverse consequences to expensive equipment. Then, a qualified service technician is required to make a service call so that the problem can be diagnosed and corrected before the system can be activated again.

The device of the present invention can be incorporated as an original part of the refrigeration system, it can be added as an after market item permanently installed on an existing refrigeration system, or it can be used as a portable service tool which can be temporarily attached to different refrigeration systems in order to obtain representative samples of the operating characteristics. The data can be collected over an extended time period to indicate any trends that may be present. For example, each condition can be sensed every ten minutes over a period of five days, and the data can be presented in the form of a graph or in any other meaningful format.

Preferably, the device includes a display such as a liquid crystal display, along with a key pad for entering program commands and functions and LED indicators for identifying alarm conditions. The data can be displayed on the LCD screen on the unit, it can be printed out by a printer, or it can be transmitted via a modem over telephone lines to allow display on a remote computer screen. Alternatively, the unit can be programmed to automatically dial a programmed telephone number in the event of a compressor shut down so that appropriate personnel are alerted to the problem and can take whatever corrective action is indicated under the circumstances.

DESCRIPTION OF THE DRAWINGS

In the accompanying drawings which form a part of the specification and are to be read in conjunction therewith and in which like reference numerals are used to indicate like parts in the various views:

FIG. 5 is a flow chart of the subroutine used to monitor the pressure on the suction side of the compressor;

FIG. 6 is a flow chart of the subroutine used to monitor the oil pressure;

FIG. 7 is a flow chart of the subroutine used to monitor the pressure on the discharge side of the compressor;

FIG. 8 is a flow chart of the subroutine used to monitor the temperature on the discharge side of the compressor; and FIG. 9 is a flow chart of the subroutine used to monitor the superheat on the suction side of the compressor.

DETAILED DESCRIPTION OF THE INVENTION

Figure 1:
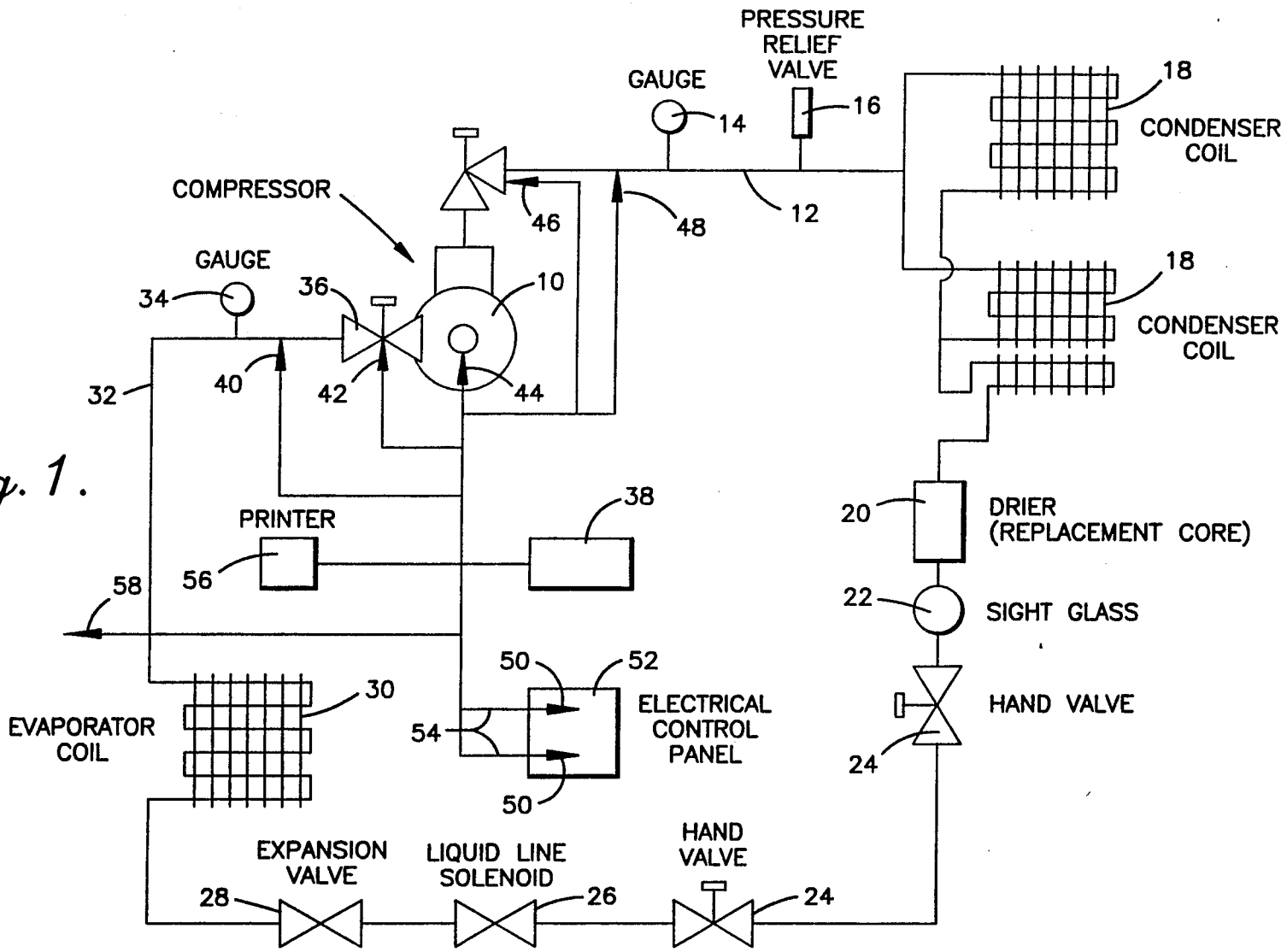
FIG. 1 is a diagrammatic depiction of a refrigeration system which incorporates a compressor control device constructed in accordance with a preferred embodiment of the present invention.

Referring now to the drawings in more detail and initially to FIG. 1, a conventional refrigeration or air conditioning system includes a compressor 10 which is driven by an electric motor in a conventional manner. The discharge side of the compressor 10 connects with a discharge line 12 equipped with a pressure gauge 14 and a pressure relief valve 16. The discharge line 12 delivers gaseous refrigerant to one or more condenser coils 18 in which the refrigerant is condensed to a liquid state. Downstream from the condenser coils 18, the liquid refrigerant passes serially through a drier 20, a sight glass 22, a pair of manually operated valves 24 and a liquid line solenoid valve 26. After passing through an expansion valve 28, the refrigerant is boiled in an evaporator coil 30. The gaseous refrigerant that is discharged from the evaporator coil is applied to the suction or intake side of the compressor 10 through a suction line 32 which may be equipped with a pressure gauge 34 and a manual valve 36. The cooling system is conventional and makes use of a conventional refrigerant. However, it is to be understood that the control device of the present invention may be used with cooling systems that differ from the specific system depicted in FIG. 1.

In accordance with the present invention, the operation of the compressor 10 is monitored and controlled by a microprocessor based control device which is identified by numeral 38 in FIG. 1. The control device 38 receives inputs from a number of different sensors which monitor the operating conditions generally associated with the compressor 10. A temperature sensor 40 is located in the suction line 32 of the compressor and provides device 38 with information as to the refrigerant temperature on the suction side of the compressor. A pressure transducer 42 monitors the pressure of the refrigerant in the suction line 32 and provides the device 38 with information as to the suction pressure. Another pressure transducer 44 senses the pressure of the lubricating oil that is used for lubrication of the compressor 10 and provides oil pressure information to the device 38. Another pressure transducer 46 senses the pressure in the compressor discharge line 12 on the high pressure side of the compressor. Again, this information is supplied to the device 38 as one of its inputs. The temperature of the refrigerant in the discharge line 12 is sensed by a temperature sensor 48 which provides another input to the device 38. The electric current that is drawn by the motor of the compressor 10 during operation of the compressor is sensed by one or more current sensors 50 associated with the electrical control panel 52 which supplies electrical power for operation of the compressor. The device 38 receives electrical power from the control panel 52 through suitable power connections 54.

Output signals from the device 38 may be applied to a suitable printer 56 in order to provide a printed record of the information that is monitored by the device. Another output signal from the device 38 may be applied to a modem 58 which is used for communications along telephone lines in a manner that will be explained more fully.

Figure 2:
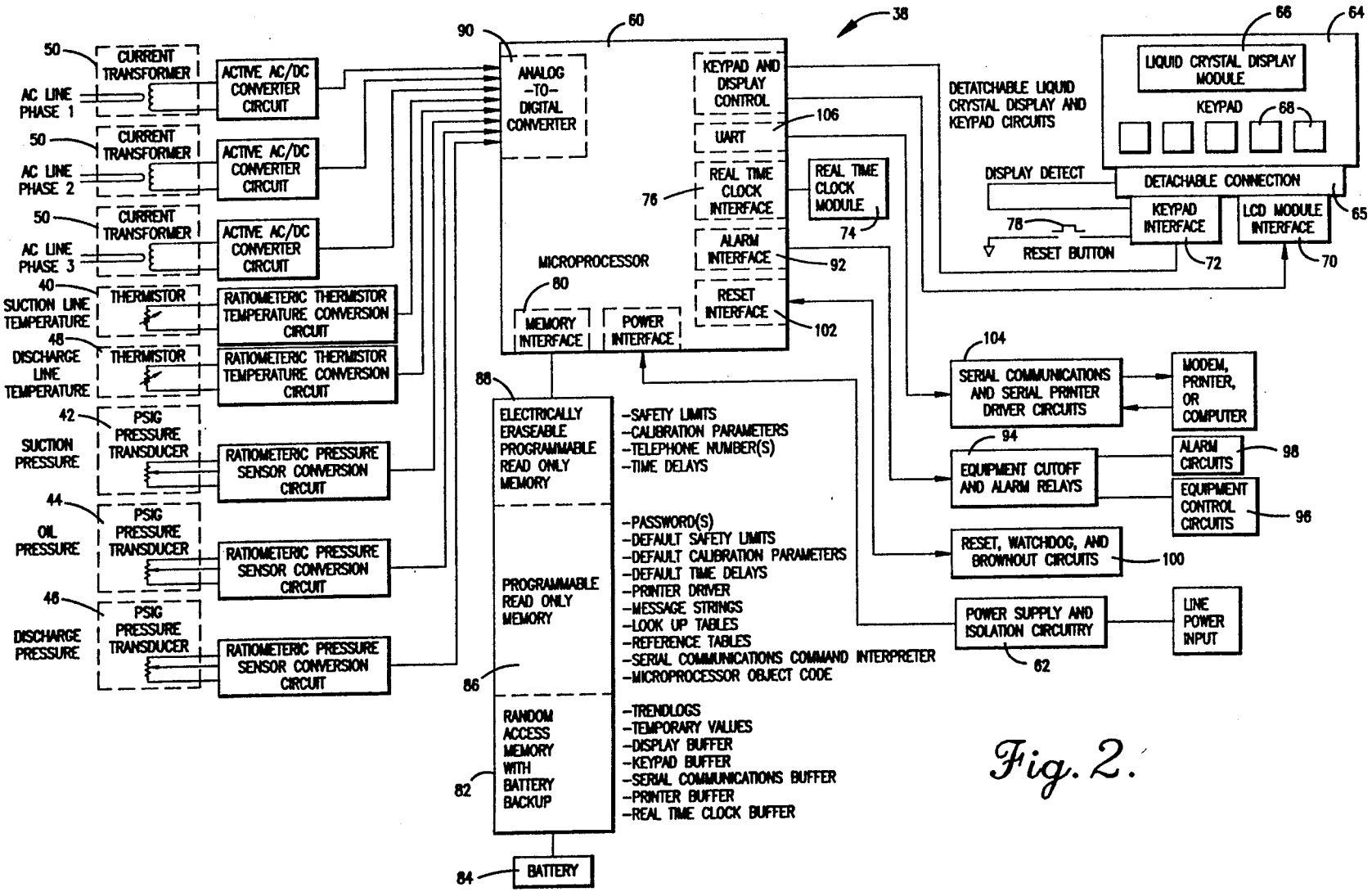
FIG. 2 is a block diagram of the pressure control device.

Referring now more particularly to FIG. 2, the device 38 includes a conventional microprocessor 60 which receives power from a power supply 62 connected with the incoming AC power lines. The device 38 may be factory programmed or provided with an optional programming and display module 64 which permits programming in the field. The module 64 may be attached to the device through a detachable connection 65. The module 64 includes a liquid crystal display screen 66 and a key pad which includes a number of different keys 68. The LCD display 66 has a suitable interface 70 with the microprocessor 60. Similarly, the key pad has an interface 72 with the microprocessor. A clock module 74 connects with the microprocessor 60 through a suitable interface 76. A reset button 78 is provided on the device 38 and permits the device to be reset twice, as will be explained more fully.

The device 38 is provided with memory circuits which connect with the microprocessor 60 through a memory interface 80. The memory circuits include a random access memory (RAM) 82 having a back up battery 84, a programmable read only memory (PROM) 86, and an electrically erasable programmable read only memory (EEPROM) 88.

The suction line temperature sensor 40 may be a conventional sensor which provides one of the inputs to the microprocessor 60 through a suitable conversion circuit and an analog to digital converter 90. Sensors 42, 44, 46 and 48 similarly provide inputs to the microprocessor 60 through conversion circuits and the analog to digital converter 90. Preferably, the current sensors 50 are three in number and are provided in the form of transformers for the three phases of the electric motor that operates the compressor 10. The current draw for each phase of the motor is applied from the respective sensors 50 through suitable converter circuits to the analog to digital converter 90.

Alarm output signals from the microprocessor 60 are provided through an alarm interface 92 to operate relay circuits 94. The relay circuits 94 control equipment control circuits 96 which shut off the compressor 10 and may perform other functions as well. The relay circuits 94 also control alarm circuits 98 which generate suitable visual and/or audio alarms when the compressor is shut off. Preferably, the device 38 is provided with a face panel that includes a series of LEDs, one indicating when the power for the unit is on, another indicating a superheat failure condition, another indicating a high current failure condition, another indicating a low suction pressure failure condition, another indicating a high discharge temperature failure condition, another indicating a high discharge pressure failure condition, another indicating a low oil pressure failure condition, and the last indicating that the unit has been reset twice. These LEDs are controlled by the alarm circuits 98. If desired, the alarm circuits may energize an audio alarm in the event of a failure condition.

The device may also include reset, watch dog and brown out circuits which are identified collectively by numeral 100 and which have a reset interface 102 with the microprocessor 60. Optional communications and printer driver circuitry 104 may be provided and may interface with the microprocessor through a UART chip 106. Circuitry 104 is used to suitably operate a conventional printer, a modem attached to telephone lines, or a computer monitor on which output information from the device is displayed at a remote location.

Figures 3, 4:
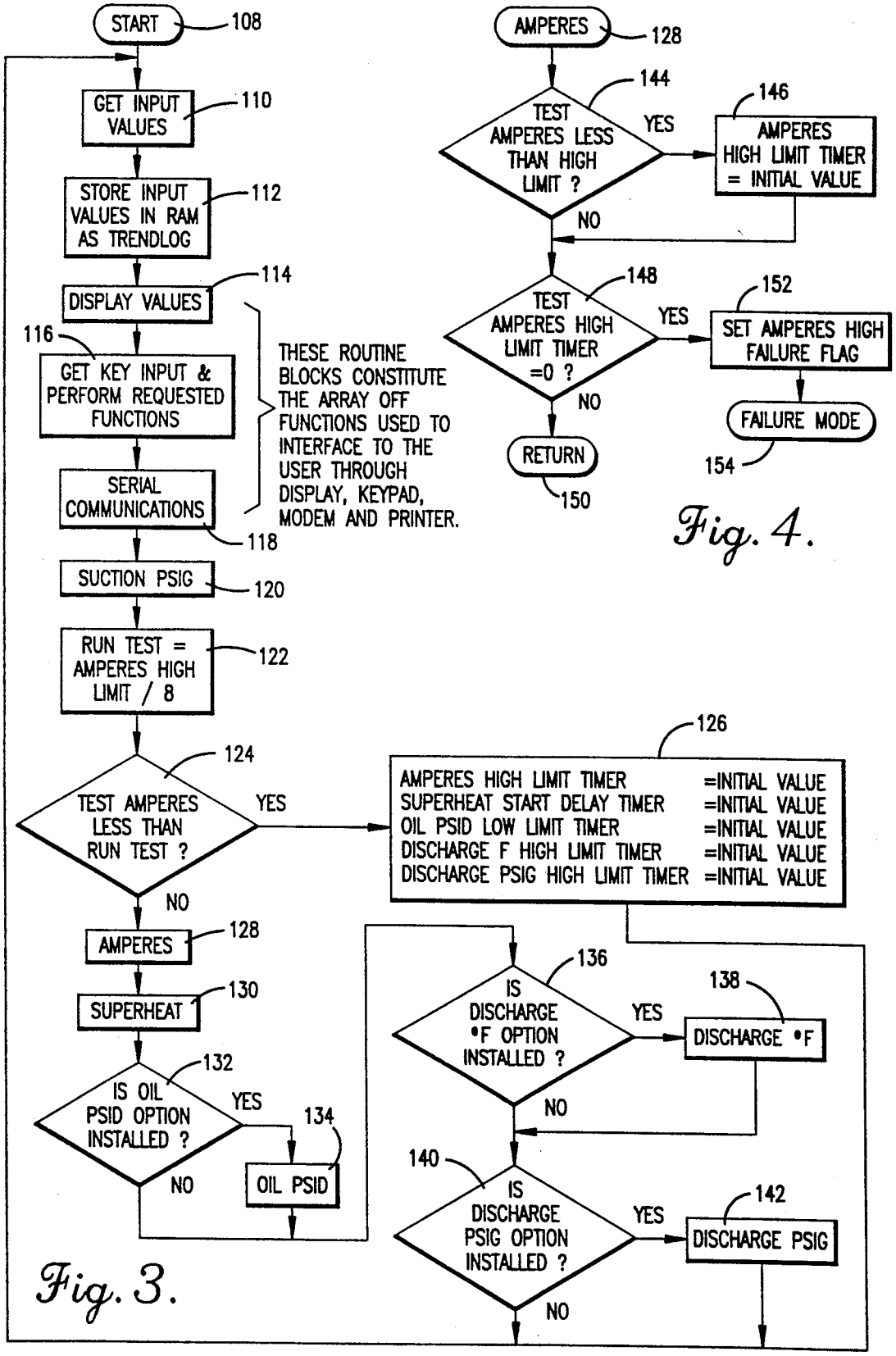
FIG. 3 is a flow chart of the software that is used in the compressor control device.
FIG. 4 is a flow chart of the software subroutine used to monitor the current draw of the compressor.

FIG. 3 depicts in flow chart from the software for the device 38. From a start block 108, block 110 is entered to obtain the input values of the conditions that are being monitored. These include the suction line temperature sensed by the temperature sensor 40, the suction pressure sensed by the pressure transducer 42, the oil pressure sensed by transducer 44, the discharge pressure sensed by transducer 46, the discharge line temperature sensed by the temperature sensor 48 and the motor current draw sensed by the three current sensors 50. In block 112, the input values are stored in the RAM 82.

If the module 64 is attached to the unit, block 114 is then entered and the input values which are stored in the RAM 82 are serially displayed on the LCD display screen 66. In block 116, the information input on the keys 68 is obtained, and the functions that are requested are carried out, as will be explained more fully. If the communications and printer driver circuitry 104 is provided, block 118 is entered and the input information is printed by a printer, is displayed on a remote computer screen, or is transmitted via modem and telephone lines to a remote location.

When block 120 is entered, a suction pressure sub routine is carried out, as will be explained in more detail. In block 122, a test is carried out in which the high amperage limit is divided by 8. The high amperage limit may be programmed into the unit at the factory or programmed in the field through entries on the key pad. In block 124, a comparison is made as to whether the amperage measured by the sensors 50 is less than the result of the test performed in block 122. If the comparison made in block 124 indicates that the amperage that is sensed is less than that determined by the test, block 126 is entered. In block 126, various time out periods are set at preprogrammed initial values. For example, an amperage high limit timer, a superheat start delay timer, an oil pressure low limit timer, a discharge temperature high limit timer and a discharge pressure high limit timer are all set at initial values which are either programmed at the factory or in the field through entries made on the key pad. From block 126, block 110 is entered again.

If the comparison made in block 124 indicates that the amperage that is sensed is not less than the amperage determined by the test carried out in block 122, blocks 128 and 130 are entered in succession, and subroutines that will be explained more fully are carried out. From block 130, block 132 is entered to determine whether the oil pressure monitoring option has been installed. If it has, an oil pressure subroutine is carried out in block 134 and block 136 is entered. If the oil pressure option is not installed, block 136 is entered directly from block 132.

In block 136, a determination is made as to whether or not the discharge temperature sensing option has been installed. If it has, block 138 is entered and a discharge temperature subroutine is carried out prior to entering block 140. If the discharge temperature option is not installed block 140 is entered directly from block 136. In block 140, a determination is made as to whether the discharge pressure sensing option has been installed. If it has, block 142 is entered and a discharge pressure subroutine is carried out prior to entering block 110 again. If the discharge pressure option is not installed, block 110 is entered directly from block 140.

FIG. 4 is a flow chart for the subroutine that determines when the motor current draw is unduly high. A predetermined high limit for the current draw is established and may be entered in the EEPROM 88. The amperes subroutine which is entered at block 128 involves comparing in block 144 the amperage sensed by the sensors 50 with the predetermined high amperage limit. If the amperage is less than the high limit, block 146 is entered and the high limit timer value is set to a predetermined initial value. Block 148 is then entered from block 146. If the amperage that is monitored is not less than the high limit, block 148 is entered directly from block 144. In block 148, a determination is made as to whether the time period established by the high limit timer has elapsed. If it has not, a return block 150 is entered and a return is made to the main program. If the high limit timer period has elapsed, block 152 is entered from block 148 and the high amperage failure flag is set. From block 152, a failure mode block 154 is entered to indicate that a failure has occurred.

FIG. 5 is a flow chart for the suction pressure subroutine 120 which determines when the suction pressure is unduly low. In the initial block 156, the pressure that is sensed by the suction pressure sensor 42 is compared with a preselected low limit. If the measured pressure is greater than the low limit, block 158 is entered and the suction pressure low limit timer is set equal to a preestablished initial value before block 160 is entered. If the pressure that is being measured is not greater than the low limit, block 160 is entered directly from block 156. In block 160, a determination is made as to whether the time out period has elapsed. If it has not, a return block 162 is entered and a return is made to the main program. If the time out period has elapsed, blocks 164 and 166 are entered in succession to indicate a failure mode.

FIG. 6 depicts in flow chart for the oil pressure subroutine 134 which determines when the oil pressure for the lubricating oil of the compressor is unduly low. In block 168, the oil pressure sensed by sensor 44 is compared with a preestablished low limit. If the oil pressure is greater than the low limit, block 170 is entered and the low limit timer for the oil pressure is set to a preestablished initial value prior to entering block 172. If the test carried out in block 168 is not met, block 172 is entered directly from block 168. In block 172, a determination is made as to whether or not the time out period for the low oil pressure has elapsed. If it has not, the return block 174 is entered. If the time period has elapsed, blocks 176 and 178 are entered to indicate a failure mode.

In FIG. 7, the subroutine 140 for the discharge pressure of the compressor is depicted. In block 180, the pressure sensed by pressure transducer 46 is compared with a preestablished high limit. If the actual pressure is less than the high limit, block 182 is entered and the discharge pressure timing period is set at its initial value. Block 184 is then entered to test whether or not the high limit time period has elapsed. If the discharge pressure is not less than the high limit, block 184 is entered directly from block 180. In block 184, a test is carried out to determine whether or not the high limit timer has decremented to zero. If the time out period has not elapsed, the return block 186 is entered. If the time out period has elapsed, blocks 188 and 190 are entered to indicate a failure mode in the discharge pressure condition.

FIG. 8 depicts the subroutine 138 for the discharge temperature. In block 192, a test is carried out to determine whether the discharge temperature is less than a preselected high limit. If it is, block 194 is entered to set the discharge temperature high limit timer to an established initial value prior to entering block 196. If the high limit for the discharge temperature is exceeded, block 196 is entered directly from block 192. In block 196, a determination is made as to whether or not the high limit timer has run out. If it has not, the return block 198 is entered. If the time period for the discharge temperature has elapsed, blocks 200 and 202 are entered to indicate a failure mode in the discharge temperature condition.

One of the principal functions of the device 38 is to effect automatic shut down of the compressor 10 in the event that the suction line 32 contains undue amounts of liquid refrigerant. For the refrigerants that are commonly used, data exists in the form of tables indicating at different pressure and temperature conditions whether or not there is a superheat condition present corresponding to a fully gaseous state of the refrigerant. These data are entered into the device in the form of look up tables stored in the PROM 86. Thus, for each combination of suction pressure and temperature sensed by the temperature sensor 40 and the pressure transducer 42, the look up tables contain a particular superheat value which is determined in block 130.

Referring particularly to FIG. 9, block 204 is entered from block 130. A preselected time delay is entered into the program to provide time for the superheat to achieve a stable or equilibrium condition after the compressor is turned on. In block 204, a test is carried out to determine whether the start delay time period has elapsed. If it has not, block 206 is entered and high and low limit timers for the superheat are set to their initial value prior to entering block 208. If the start delay period has elapsed, block 208 is entered directly from block 204. In block 208, the superheat which is determined from the look up table is compared against a preestablished high limit value. If the superheat is less than the high limit value, block 210 is entered and the high limit timer for the superheat is set at its initial value prior to entering block 212. If the superheat that is measured is not less than the high limit, block 212 is entered directly from block 208.

In block 212, the superheat that is determined from the look up tables is compared with a preselected low limit. If the superheat is greater than the low limit, block 214 is entered and the low limit timer for the superheat is set at its initial value prior to entering block 216. If the superheat is not greater than the low limit, block 216 is entered directly from block 212. In block 216, a determination is made as to whether the high limit timer for the superheat has run out. If it has, block 218 is entered and the superheat failure flag is set prior to entering the failure mode block 220. If the superheat high limit timer has not run out, block 222 is entered from block 216 to determine whether the low limit timer for the superheat has run out. If it has, block 218 is entered from block 222. If it has not, the return block 224 is entered from block 222.

In operation, the device 38 monitors the various operating conditions associated with the compressor 10 and acts to provide the information which is monitored and to automatically shut down the compressor 10 if the compressor is operating under conditions that could cause damage to it. If the display module 64 is used, the device can be programmed in the field through the keys 68 on the key pad, and the display screen 66 provides various displays. Normally, the display screen 66 is in a display mode during which the conditions that are monitored by the various sensors are serially displayed, with each condition being displayed on the screen 66 for a selected time period. The key pad preferably includes one key 68 having an up arrow which can be depressed in order to achieve a rapid advance through the conditions that are being monitored. Another of the keys 68 preferably has a down arrow which can be depressed in the normal display mode in order to rapidly advance in a reverse order through the display of the conditions that are being monitored. Another of the keys 68 is preferably an enter key which can be depressed in the normal display mode to lock in the display on a particular condition, and that condition will be continuously updated on the display screen 66. Another of the keys 68 may be a cancel key which can be depressed to enter the normal display mode again.

The final key 68 may be a function key which can be depressed to display a function menu on the screen 66. Although various functions can be included in the function menu, one of them is preferably a print function. Selection of the print function initiates operation of a printer that is attached through the serial communications circuitry 104.

Another available function is a set function. If it is selected, the display 66 requests entry of a valid pass code. The user must then enter a valid pass code in order to gain entry to the set menu. If a valid pass code is not entered with 30 seconds, the unit automatically reverts to the normal display mode.

In the set function mode, one of the menu options is a time setting in which the current time and date are entered into the unit. Another option in the set menu is a scale setting function. In this mode, the screen 66 displays various questions and prompts asking the user to enter various types of information such as which of the optional sensors is installed.

Another of the options available on the set menu is the limit setting function. In this mode, the user is able to program the various high and low limits for the different conditions that are monitored by the device and to program the various time periods during which the conditions must be out of a safe range before an alarm condition is recognized. The limits and time out periods are entered through the key pad and are held in the EEPROM 88. In the PROM 86, predetermined default values are provided for the safety limits, calibration parameters and time out periods. If the user fails to select values for any of these, the default values are automatically used.

When the compressor 10 is in operation, the sensors monitor the various conditions of the cooling system and display the monitored conditions on the LCD screen 66, on a remote monitor through the serial communications circuitry 104, and/or provide a printed record of them if a printer is attached. If any one of the conditions that is being monitored is sensed as being outside of the established limit or limits, and if it remains outside of the established limit or limits throughout the duration of the time out period for that particular condition, then the device enters the failure mode. Through the alarm interface 92, the relay circuitry 94 is activated and causes the equipment control circuit 96 to immediately shut off the compressor 10 in order to prevent it from being damaged. At the same time, the relay circuit 94 activates the alarm circuits 98 in order to energize the alarm LED associated with the fault condition. The LED provides a visual indication of the particular condition that is abnormal (such as an unduly low suction pressure indicating that insufficient refrigerant is in the system or an unduly low superheat indicating that too much liquid refrigerant is present at the suction or intake to the compressor 10). If a modem is present and connected with the microprocessor through circuit 104, a selected telephone number can be automatically dialed to provide a telephone message indicating that the compressor has been shut down because of a fault condition. Appropriate personnel who are off-site can thus be alerted by telephone that there is a problem.

The device 38 can be reset and the compressor 10 can be started up to two times simply by depressing the rest button 78. Thus, if there is a fault condition due to an external factor such as a power "brownout" or some other external problem not indicative of a problem with the refrigeration system, the user can reset the device. However, if the compressor is shut down by the device after two resets have been effected, the reset button 78 is thereafter ineffective and it is necessary for a service technician to make a service call in order to allow the compressor to be started again. Therefore, if a problem persists causing the system to shut down three times, there is a high probability that the refrigeration system is subject to a problem that could possibly damage the compressor or other components. Then, the service technician must inspect the system and take whatever corrective action is required to allow the system to operate safely and normally.

In this manner, the device 38 monitors the operation of the compressor 10 and immediately shuts it down if a problem condition is sensed that could lead to compressor damage. It is particularly important to monitor the superheat on the suction side of the compressor to make certain that there is not an undue amount of liquid refrigerant present that could cause a "wash out" or undue slugging of the compressor that could have serious adverse consequences. In addition, by monitoring the suction pressure, assurance is provided that adequate refrigerant is present in the system to properly cool the compressor and prevent overheat of the motor or other important components.

The device 38 is particularly useful in monitoring the operation of a large compressor of the type used in the air conditioning systems for large industrial, commercial and office buildings. These compressors are expensive and it is particularly important to avoid damage to them. The device 38 is also applicable in cooling processes that require cooling of expensive materials used in critical industrial or medical processes.

The device 38 can be provided as an original part of the refrigeration system or it can be permanently installed as part of an existing refrigeration system. Alternatively, the device can be provided as a portable servicing tool which can be temporarily attached to a refrigeration system in order to monitor its operation for a preselected time period such as a one or two day period to determine if there are any operating irregularities. By providing for the field programming of the limits and time out periods, users can customize the device in the field to conform with different types of cooling systems which may require different limits and time out periods. Consequently, the device is adapted for use with a wide variety of different types and sizes of mechanical cooling systems.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A microprocessor based apparatus for monitoring the operation of a cooling system which includes a compressor having a suction side to which refrigerant gas is delivered and a discharge side from which the refrigerant gas is discharged, said apparatus comprising:

microprocessor means;

a visual display controlled by said microprocessor means;

means for sensing the superheat condition of the refrigerant gas at the suction side of the compressor;

means for monitoring additional operating parameters of the cooling system;

means for entering in said microprocessor means a selected superheat value indicative of a gaseous state of the refrigerant;

means associated with said microprocessor means for comparing the superheat condition sensed by said sensing means with said selected superheat value and for deactivating the compressor when the superheat condition sensed by said sensing means drops below said selected superheat value;

means for displaying on said visual display the superheat condition sensed by said sensing means and the values of said additional operating parameters; and means for providing a printed record of the superheat condition sensed by said sensing means and the values of said additional operating parameters.

* * * * *